US009273460B2

(12) United States Patent
Hohmann, Jr.

(10) Patent No.: US 9,273,460 B2
(45) Date of Patent: Mar. 1, 2016

(54) BACKUP WALL REINFORCEMENT WITH T-TYPE ANCHOR

(71) Applicant: MITEK HOLDINGS, INC., Wilmington, DE (US)

(72) Inventor: Ronald P. Hohmann, Jr., Hauppauge, NY (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 14/456,724

(22) Filed: Aug. 11, 2014

(65) Prior Publication Data

US 2014/0345208 A1 Nov. 27, 2014

Related U.S. Application Data

(62) Division of application No. 13/426,285, filed on Mar. 21, 2012, now Pat. No. 8,800,241.

(51) Int. Cl.

| | |
|---|---|
| ***E04B 1/41*** | (2006.01) |
| ***E04B 2/54*** | (2006.01) |
| ***E04B 1/98*** | (2006.01) |

(Continued)

(52) U.S. Cl.

CPC ..... *E04B 1/4178* (2013.01); *E04B 1/98* (2013.01); *E04B 2/44* (2013.01); *E04B 2/54* (2013.01); *E04B 1/7616* (2013.01)

(58) Field of Classification Search

CPC ..... E04B 1/4178; E04B 1/4185; E04B 2/30; E04B 2001/405; E04B 2001/4192; E04B 2002/0282; E04B 2/44; E04B 2/54; E04B 1/7616; E04H 9/02; E04C 5/18

USPC ..... 52/379, 712, 713, 506.01, 426, 513, 52/562, 565, 167.1

See application file for complete search history.

(56) References Cited

U.S. PATENT DOCUMENTS

| | | | |
|---|---|---|---|
| 819,869 | A | 5/1906 | Dunlap |
| 903,000 | A | 11/1908 | Priest |
| 1,014,157 | A | 1/1912 | Lewen |

(Continued)

FOREIGN PATENT DOCUMENTS

| | | |
|---|---|---|
| CH | 279209 | 3/1952 |
| EP | 0 199 595 B1 | 3/1995 |

(Continued)

OTHER PUBLICATIONS

ASTM Standard E754-80 (2006), Standard Test Method for Pullout Resistance of Ties and Anchors Embedded in Masonry Mortar Joints, ASTM International, 8 pages, West Conshohocken, Pennsylvania, United States.

(Continued)

*Primary Examiner* — Brent W Herring
(74) *Attorney, Agent, or Firm* — Senniger Powers LLP

(57) ABSTRACT

A hybrid wall reinforcement wall anchoring system is described for use in masonry cavity walls. The reinforcement and anchor is hybrid device installed within the backup wall and interlocked with novel veneer ties. The novel veneer ties are wire formatives and are manually connected and interlocked with the anchor. Once interlocked and installed within the cavity wall, lateral, vertical and front-to-back veneer tie movement is limited, strengthening the cavity wall structure. The inclusion of a reinforcement wire within the veneer tie and the exterior wall provides a seismic structure.

14 Claims, 7 Drawing Sheets

(51) Int. Cl.

| | |
|---|---|
| ***E04B 2/44*** | (2006.01) |
| *E04B 1/76* | (2006.01) |

(56) References Cited

U.S. PATENT DOCUMENTS

| | | | | |
|---|---|---|---|---|
| 1,170,419 | A | | 2/1916 | Coon et al. |
| RE15,979 | E | | 1/1925 | Schaefer et al. |
| 1,794,684 | A | | 3/1931 | Handel |
| 1,936,223 | A | | 11/1933 | Awbrey |
| 1,988,124 | A | | 1/1935 | Johnson |
| 2,058,148 | A | | 10/1936 | Hard |
| 2,097,821 | A | | 11/1937 | Mathers |
| 2,280,647 | A | | 4/1942 | Hawes |
| 2,300,181 | A | | 10/1942 | Spaight |
| 2,343,764 | A | | 3/1944 | Fuller |
| 2,403,566 | A | | 7/1946 | Thorp et al. |
| 2,413,772 | A | | 1/1947 | Morehouse |
| 2,605,867 | A | | 8/1952 | Goodwin |
| 2,780,936 | A | | 2/1957 | Hillberg |
| 2,898,758 | A | | 8/1959 | Henrickson |
| 2,909,054 | A | | 10/1959 | Phillips |
| 2,929,238 | A | | 3/1960 | Kaye |
| 2,966,705 | A | | 1/1961 | Massey |
| 2,999,571 | A | | 9/1961 | Huber |
| 3,030,670 | A | | 4/1962 | Bigelow |
| 3,088,361 | A | | 5/1963 | Hallock |
| 3,114,220 | A | | 12/1963 | Maddox et al. |
| 3,121,978 | A | | 2/1964 | Reiland |
| 3,183,628 | A | | 5/1965 | Smith |
| 3,254,736 | A | | 6/1966 | Gass |
| 3,277,626 | A | | 10/1966 | Brynjolfsson et al. |
| 3,300,939 | A | | 1/1967 | Brynjolfsson et al. |
| 3,309,828 | A | | 3/1967 | Tribble |
| 3,310,926 | A | | 3/1967 | Brandreth et al. |
| 3,341,998 | A | | 9/1967 | Lucas |
| 3,342,005 | A | | 9/1967 | Rickards et al. |
| 3,377,764 | A | | 4/1968 | Storch |
| 3,478,480 | A | | 11/1969 | Swenson |
| 3,563,131 | A | | 2/1971 | Ridley, Sr. |
| 3,568,389 | A | | 3/1971 | Gulow |
| 3,640,043 | A | | 2/1972 | Querfeld et al. |
| 3,925,996 | A | | 12/1975 | Wiggill |
| 3,964,226 | A | | 6/1976 | Hala et al. |
| 3,964,227 | A | | 6/1976 | Hala |
| 4,021,990 | A | | 5/1977 | Schwalberg |
| 4,060,951 | A | | 12/1977 | Gere |
| 4,227,359 | A | | 10/1980 | Schlenker |
| 4,238,987 | A | | 12/1980 | Siebrecht-Reuter |
| 4,281,494 | A | | 8/1981 | Weinar |
| 4,305,239 | A | | 12/1981 | Geraghty |
| 4,373,314 | A | | 2/1983 | Allan |
| 4,382,416 | A | | 5/1983 | Kellogg-Smith |
| 4,410,760 | A | | 10/1983 | Cole |
| 4,424,745 | A | | 1/1984 | Magorian et al. |
| 4,438,611 | A | | 3/1984 | Bryant |
| 4,473,984 | A | | 10/1984 | Lopez |
| 4,482,368 | A | | 11/1984 | Roberts |
| 4,484,422 | A | | 11/1984 | Roberts |
| 4,523,413 | A | | 6/1985 | Koppenberg |
| 4,571,909 | A | | 2/1986 | Berghuis et al. |
| 4,596,102 | A | | 6/1986 | Catani et al. |
| 4,598,518 | A | | 7/1986 | Hohmann |
| 4,606,163 | A | | 8/1986 | Catani |
| 4,622,796 | A | | 11/1986 | Aziz et al. |
| 4,628,657 | A | | 12/1986 | Ermer et al. |
| 4,636,125 | A | | 1/1987 | Burgard |
| 4,640,848 | A | | 2/1987 | Cerdan-Diaz et al. |
| 4,660,342 | A | | 4/1987 | Salisbury |
| 4,688,363 | A | * | 8/1987 | Sweeney et al. ..... 52/562 |
| 4,703,604 | A | | 11/1987 | Muller |
| 4,708,551 | A | | 11/1987 | Richter et al. |
| 4,714,507 | A | | 12/1987 | Ohgushi |
| 4,738,070 | A | | 4/1988 | Abbott et al. |
| 4,757,662 | A | | 7/1988 | Gasser |
| 4,764,069 | A | | 8/1988 | Reinwall et al. |
| 4,819,401 | A | | 4/1989 | Whitney, Jr. |
| 4,827,684 | A | | 5/1989 | Allan |
| 4,843,776 | A | | 7/1989 | Guignard |
| 4,852,320 | A | | 8/1989 | Ballantyne |
| 4,869,038 | A | | 9/1989 | Catani |
| 4,869,043 | A | | 9/1989 | Hatzinikolas et al. |
| 4,875,319 | A | | 10/1989 | Hohmann |
| 4,911,949 | A | | 3/1990 | Iwase et al. |
| 4,922,680 | A | | 5/1990 | Kramer et al. |
| 4,946,632 | A | | 8/1990 | Pollina |
| 4,955,172 | A | | 9/1990 | Pierson |
| 5,063,722 | A | | 11/1991 | Hohmann |
| 5,099,628 | A | | 3/1992 | Noland et al. |
| 5,207,043 | A | | 5/1993 | McGee et al. |
| 5,307,602 | A | | 5/1994 | Lebraut |
| 5,392,581 | A | | 2/1995 | Hatzinikolas et al. |
| 5,408,798 | A | | 4/1995 | Hohmann |
| 5,440,854 | A | | 8/1995 | Hohmann |
| 5,454,200 | A | | 10/1995 | Hohmann |
| 5,456,052 | A | | 10/1995 | Anderson et al. |
| 5,490,366 | A | | 2/1996 | Burns et al. |
| 5,598,673 | A | | 2/1997 | Atkins |
| 5,634,310 | A | | 6/1997 | Hohmann |
| 5,644,889 | A | | 7/1997 | Getz |
| 5,669,592 | A | | 9/1997 | Kearful |
| 5,671,578 | A | | 9/1997 | Hohmann |
| 5,673,527 | A | | 10/1997 | Coston et al. |
| 5,755,070 | A | | 5/1998 | Hohmann |
| 5,816,008 | A | | 10/1998 | Hohmann |
| 5,819,486 | A | | 10/1998 | Goodings |
| 5,845,455 | A | | 12/1998 | Johnson, III |
| 5,953,865 | A | | 9/1999 | Rickards |
| 6,000,178 | A | | 12/1999 | Goodings |
| 6,098,364 | A | | 8/2000 | Liu |
| 6,125,608 | A | | 10/2000 | Charlson |
| 6,209,281 | B1 | | 4/2001 | Rice |
| 6,279,283 | B1 | | 8/2001 | Hohmann et al. |
| 6,284,311 | B1 | | 9/2001 | Gregorovich et al. |
| 6,332,300 | B1 | | 12/2001 | Wakai |
| 6,351,922 | B1 | | 3/2002 | Burns et al. |
| 6,367,219 | B1 | | 4/2002 | Quinlan |
| 6,508,447 | B1 | | 1/2003 | Catani et al. |
| 6,548,190 | B2 | | 4/2003 | Spitsberg et al. |
| 6,612,343 | B2 | | 9/2003 | Camberlin et al. |
| 6,627,128 | B1 | | 9/2003 | Boyer |
| 6,668,505 | B1 | | 12/2003 | Hohmann et al. |
| 6,686,301 | B2 | | 2/2004 | Li et al. |
| 6,718,774 | B2 | | 4/2004 | Razzell |
| 6,735,915 | B1 | | 5/2004 | Johnson, III |
| 6,739,105 | B2 | | 5/2004 | Fleming |
| 6,789,365 | B1 | | 9/2004 | Hohmann et al. |
| 6,812,276 | B2 | | 11/2004 | Yeager |
| 6,817,147 | B1 | | 11/2004 | MacDonald |
| 6,827,969 | B1 | | 12/2004 | Skoog et al. |
| 6,837,013 | B2 | | 1/2005 | Foderberg et al. |
| 6,851,239 | B1 | | 2/2005 | Hohmann et al. |
| 6,918,218 | B2 | | 7/2005 | Greenway |
| 6,925,768 | B2 | | 8/2005 | Hohmann et al. |
| 6,941,717 | B2 | | 9/2005 | Hohmann et al. |
| 6,968,659 | B2 | | 11/2005 | Boyer |
| 7,007,433 | B2 | | 3/2006 | Boyer |
| 7,017,318 | B1 | | 3/2006 | Hohmann et al. |
| 7,043,884 | B2 | | 5/2006 | Moreno |
| 7,059,577 | B1 | | 6/2006 | Burgett |
| D527,834 | S | | 9/2006 | Thimons et al. |
| 7,147,419 | B2 | | 12/2006 | Balbo Di Vinadio |
| 7,152,382 | B2 | | 12/2006 | Johnson, III |
| 7,171,788 | B2 | | 2/2007 | Bronner |
| 7,178,299 | B2 | | 2/2007 | Hyde et al. |
| D538,948 | S | | 3/2007 | Thimons et al. |
| 7,225,590 | B1 | | 6/2007 | diGirolamo et al. |
| 7,325,366 | B1 | | 2/2008 | Hohmann, Jr. et al. |
| 7,334,374 | B2 | | 2/2008 | Schmid |
| 7,374,825 | B2 | | 5/2008 | Hazel et al. |
| 7,415,803 | B2 | | 8/2008 | Bronner |
| 7,469,511 | B2 | | 12/2008 | Wobber |
| 7,481,032 | B2 | | 1/2009 | Tarr |
| 7,552,566 | B2 | | 6/2009 | Hyde et al. |
| 7,562,506 | B2 | | 7/2009 | Hohmann, Jr. |

(56) References Cited

U.S. PATENT DOCUMENTS

| | | | | |
|---|---|---|---|---|
| 7,587,874 | B2 | 9/2009 | Hohmann, Jr. | |
| 7,654,057 | B2 | 2/2010 | Zambelli et al. | |
| 7,735,292 | B2 | 6/2010 | Massie | |
| 7,748,181 | B1 | 7/2010 | Guinn | |
| 7,788,869 | B2 | 9/2010 | Voegele, Jr. | |
| D626,817 | S | 11/2010 | Donowho et al. | |
| 7,845,137 | B2 | 12/2010 | Hohmann, Jr. | |
| 8,015,757 | B1 | 9/2011 | Hohmann, Jr. | |
| 8,037,653 | B2 | 10/2011 | Hohmann, Jr. | |
| 8,046,956 | B1 | 11/2011 | Hohmann, Jr. | |
| 8,051,619 | B2 | 11/2011 | Hohmann, Jr. | |
| 8,096,090 | B1 | 1/2012 | Hohmann, Jr. et al. | |
| 8,109,706 | B2 | 2/2012 | Richards | |
| 8,122,663 | B1 | 2/2012 | Hohmann, Jr. et al. | |
| 8,154,859 | B2 | 4/2012 | Shahrokhi | |
| 8,201,374 | B2 | 6/2012 | Hohmann, Jr. | |
| 8,209,934 | B2 | 7/2012 | Pettingale | |
| 8,215,083 | B2 | 7/2012 | Toas et al. | |
| 8,291,672 | B2 | 10/2012 | Hohmann, Jr. et al. | |
| 8,347,581 | B2 | 1/2013 | Doerr et al. | |
| 8,375,667 | B2 | 2/2013 | Hohmann, Jr. | |
| 8,418,422 | B2 | 4/2013 | Johnson, III | |
| 8,468,765 | B1 | 6/2013 | Kim | |
| 8,511,041 | B2 | 8/2013 | Fransen | |
| 8,516,763 | B2 | 8/2013 | Hohmann, Jr. | |
| 8,516,768 | B2 | 8/2013 | Johnson, III | |
| 8,544,228 | B2 | 10/2013 | Bronner | |
| 8,555,587 | B2 | 10/2013 | Hohmann, Jr. | |
| 8,555,596 | B2 | 10/2013 | Hohmann, Jr. | |
| 8,596,010 | B2 | 12/2013 | Hohmann, Jr. | |
| 8,609,224 | B2 | 12/2013 | Li et al. | |
| 8,613,175 | B2 | 12/2013 | Hohmann, Jr. | |
| 8,635,832 | B2 | 1/2014 | Heudorfer et al. | |
| 8,661,741 | B2 | 3/2014 | Hohmann, Jr. | |
| 8,661,766 | B2 | 3/2014 | Hohmann, Jr. | |
| 8,667,757 | B1 | 3/2014 | Hohmann, Jr. | |
| 8,726,596 | B2 | 5/2014 | Hohmann, Jr. | |
| 8,726,597 | B2 | 5/2014 | Hohmann, Jr. | |
| 8,733,049 | B2 | 5/2014 | Hohmann, Jr. | |
| 8,739,485 | B2 | 6/2014 | Hohmann, Jr. | |
| 8,800,241 | B2 * | 8/2014 | Hohmann, Jr. | 52/713 |
| 8,833,003 | B1 | 9/2014 | Hohmann, Jr. | |
| 8,839,581 | B2 | 9/2014 | Hohmann, Jr. | |
| 8,839,587 | B2 | 9/2014 | Hohmann, Jr. | |
| 8,844,229 | B1 | 9/2014 | Hohmann, Jr. | |
| 8,863,460 | B2 | 10/2014 | Hohmann, Jr. | |
| 8,881,488 | B2 | 11/2014 | Hohmann, Jr. et al. | |
| 8,898,980 | B2 | 12/2014 | Hohmann, Jr. | |
| 8,904,726 | B1 * | 12/2014 | Hohmann, Jr. | 52/379 |
| 8,904,727 | B1 | 12/2014 | Hohmann, Jr. | |
| 8,904,730 | B2 | 12/2014 | Hohmann, Jr. | |
| 8,904,731 | B2 | 12/2014 | Hohmann, Jr. | |
| 8,910,445 | B2 | 12/2014 | Hohmann, Jr. | |
| 8,978,330 | B2 * | 3/2015 | Hohmann, Jr. | 52/379 |
| 9,038,351 | B2 * | 5/2015 | Hohmann, Jr. | 52/714 |
| 2001/0054270 | A1 | 12/2001 | Rice | |
| 2002/0047488 | A1 | 4/2002 | Webb et al. | |
| 2002/0100239 | A1 | 8/2002 | Lopez | |
| 2003/0121226 | A1 | 7/2003 | Bolduc | |
| 2003/0217521 | A1 | 11/2003 | Richardson et al. | |
| 2004/0083667 | A1 | 5/2004 | Johnson, III | |
| 2004/0187421 | A1 * | 9/2004 | Johnson, III | 52/415 |
| 2004/0216408 | A1 | 11/2004 | Hohmann, Jr. | |
| 2004/0216413 | A1 | 11/2004 | Hohmann et al. | |
| 2004/0216416 | A1 | 11/2004 | Hohmann et al. | |
| 2004/0231270 | A1 | 11/2004 | Collins et al. | |
| 2005/0046187 | A1 | 3/2005 | Takeuchi et al. | |
| 2005/0279042 | A1 | 12/2005 | Bronner | |
| 2005/0279043 | A1 | 12/2005 | Bronner | |
| 2006/0005490 | A1 | 1/2006 | Hohmann, Jr. | |
| 2006/0198717 | A1 | 9/2006 | Fuest | |
| 2006/0242921 | A1 | 11/2006 | Massie | |
| 2006/0251916 | A1 | 11/2006 | Arikawa et al. | |
| 2007/0011964 | A1 | 1/2007 | Smith | |
| 2008/0092472 | A1 | 4/2008 | Doerr et al. | |
| 2008/0141605 | A1 | 6/2008 | Hohmann | |
| 2008/0222992 | A1 | 9/2008 | Hikai et al. | |
| 2009/0133351 | A1 | 5/2009 | Wobber | |
| 2009/0133357 | A1 | 5/2009 | Richards | |
| 2010/0037552 | A1 | 2/2010 | Bronner | |
| 2010/0071307 | A1 | 3/2010 | Hohmann, Jr. | |
| 2010/0101175 | A1 | 4/2010 | Hohmann | |
| 2010/0192495 | A1 | 8/2010 | Huff et al. | |
| 2010/0257803 | A1 | 10/2010 | Hohmann, Jr. | |
| 2011/0023748 | A1 | 2/2011 | Wagh et al. | |
| 2011/0041442 | A1 | 2/2011 | Bui | |
| 2011/0047919 | A1 | 3/2011 | Hohmann, Jr. | |
| 2011/0061333 | A1 | 3/2011 | Bronner | |
| 2011/0083389 | A1 | 4/2011 | Bui | |
| 2011/0146195 | A1 | 6/2011 | Hohmann, Jr. | |
| 2011/0173902 | A1 | 7/2011 | Hohmann, Jr. et al. | |
| 2011/0189480 | A1 | 8/2011 | Hung | |
| 2011/0277397 | A1 | 11/2011 | Hohmann, Jr. | |
| 2012/0186183 | A1 | 7/2012 | Johnson, III | |
| 2012/0285111 | A1 | 11/2012 | Johnson, III | |
| 2012/0304576 | A1 | 12/2012 | Hohmann, Jr. | |
| 2012/0308330 | A1 | 12/2012 | Hohmann, Jr. | |
| 2013/0008121 | A1 | 1/2013 | Dalen | |
| 2013/0074435 | A1 | 3/2013 | Hohmann, Jr. | |
| 2013/0074442 | A1 | 3/2013 | Hohmann, Jr. | |
| 2013/0232893 | A1 | 9/2013 | Hohmann, Jr. | |
| 2013/0232909 | A1 | 9/2013 | Curtis et al. | |
| 2013/0247482 | A1 | 9/2013 | Hohmann, Jr. | |
| 2013/0247483 | A1 | 9/2013 | Hohmann, Jr. | |
| 2013/0247484 | A1 | 9/2013 | Hohmann, Jr. | |
| 2013/0247498 | A1 | 9/2013 | Hohmann, Jr. | |
| 2013/0340378 | A1 | 12/2013 | Hohmann, Jr. | |
| 2014/0000211 | A1 | 1/2014 | Hohmann, Jr. | |
| 2014/0075855 | A1 | 3/2014 | Hohmann, Jr. | |
| 2014/0075856 | A1 | 3/2014 | Hohmann, Jr. | |
| 2014/0075879 | A1 | 3/2014 | Hohmann, Jr. | |
| 2014/0096466 | A1 | 4/2014 | Hohmann, Jr. | |
| 2014/0174013 | A1 | 6/2014 | Hohmann, Jr. et al. | |

FOREIGN PATENT DOCUMENTS

| | | |
|---|---|---|
| GB | 1 575 501 | 9/1980 |
| GB | 2 069 024 A | 8/1981 |
| GB | 2 246 149 A | 1/1992 |
| GB | 2 265 164 A | 9/1993 |
| GB | 2459936 B | 3/2013 |

OTHER PUBLICATIONS

ASTM Standard Specification A951/A951M-11, Table 1, Standard Specification for Steel Wire for Masonry Joint Reinforcement, Nov. 14, 2011, 6 pages, West Conshohocken, Pennsylvania, United States.

State Board of Building Regulations and Standards, Building Envelope Requirements, 780 CMR sec. 1304.0 et seq., 7th Edition, Aug. 22, 2008, 11 pages, Boston, MA, United States.

Building Code Requirements for Masonry Structures and Commentary, TMS 402-11/ACI 530-11/ASCE 5-11, 2011, Chapter 6, 12 pages.

Hohmann & Barnard, Inc., Product Catalog, 44 pgs (2003).

Hohmann & Barnard, Inc.; Product Catalog, 2009, 52 pages, Hauppauge, New York, United States.

Hohmann & Barnard, Inc., Product Catalog, 2013, 52 pages, Hauppauge, New York, United States.

Kossecka, Ph.D, et al., Effect of Insulation and Mass Distribution in Exterior Walls on Dynamic Thermal Performance of Whole Buildings, Thermal Envelopes VII/Building Systems—Principles p. 721-731, 1998, 11 pages.

Canadian Office action for Application No. 2,809,381 dated Mar. 26, 2015, 6 pages.

* cited by examiner

BACKUP WALL REINFORCEMENT WITH T-TYPE ANCHOR

CROSS-REFERENCE TO RELATED APPLICATIONS

This application is a divisional of U.S. Ser. No. 13/426,285, filed Mar. 21, 2012, the entire contents of which are incorporated herein by reference.

BACKGROUND

1. Field of the Invention

This invention relates to reinforcement and anchor assemblies for use in masonry backup walls and, in particular, cavity wall constructs with backup and veneer walls that require superior anchoring properties. The backup wall reinforcement is a hybrid anchoring system which includes a reinforcement with an integrated anchor for connection to an interlocking wire formative veneer tie which, upon installation, provides a 3-axis restraint system, limiting exterior wall movement and displacement.

2. Description of the Prior Art

Masonry, the building of structures from individual units laid in and bound together by mortar, is commonly used for the construction of buildings. Such widespread use is the result of the high durability, compressive strength, thermal mass and heat resistance of the masonry building materials. Because masonry construction requires extensive manual labor and individual building materials, the quality of the masonry construction is directly dependent on the type of materials and devices used and the workmanship of the mason.

In recent years, attention has been paid to wall reinforcement for areas that are subjected to external forces such as high winds and seismic activity. To address a difficulty with masonry construction, weakness of the horizontal mortar or bed joints that bond the masonry units together, well-known devices such as ladder and truss reinforcements are used to augment the tensile strength of the horizontal mortar joints. Any weakness in the bed joints resulting from low tensile strength mortar, has been generally addressed by providing mortar joint reinforcement for structural stability. The ladder and truss reinforcements have been historically used to reduce cracking that arises from thermal stresses, to increase lateral flexural strength, and to enhance the elasticity and performance of masonry walls under various stresses.

Further seismic protection is achieved through the use of a continuous wire in the veneer masonry walls. In the past, there have been investigations relating to the effects of various forces, particularly lateral forces, upon brick veneer construction having wire formative anchors embedded in the mortar joint of anchored veneer walls. The seismic aspect of these investigations is referenced in the prior patents of R. P. Hohmann, Sr., namely, U.S. Pat. Nos. 4,875,319 and 5,408,798. Besides earthquake protection, the failure of several high-rise buildings to withstand wind and other lateral forces has resulted in the incorporation of a requirement for continuous wire reinforcement in the Uniform Building Code provisions.

The inventors' patents and their assignee's product line include masonry accessories, namely, ladder and truss reinforcements, wall anchors, veneer ties, masonry flashing and related items for cavity walls. These products, which are sold under the trademarks of Lox All, DW-10X, X-seal, and Flex-Flash, are manufactured by Hohmann & Barnard, Inc., Hauppauge, N.Y. 11788 ("H&B"), a unit of MiTek Industries, Inc., a Berkshire Hathaway subsidiary. The products have become widely accepted in the construction industry and the inventors have gained particular insight into the technological needs of the marketplace.

Recently, there have been significant shifts in public sector building specifications which have resulted in architects and architectural engineers requiring larger and larger cavities in the exterior cavity walls of public buildings. These requirements are imposed without corresponding decreases in wind shear and seismic resistance levels or increases in mortar bed joint height. Thus, the wall anchors needed are restricted to occupying the same ⅜ inch bed joint height in the inner and outer wythes. Thus, the veneer facing material is tied down over a span of two or more times that which had previously been experienced. Exemplary of the public sector building specification is that of the Energy Code Requirement, Boston, Mass. (See Chapter 13 of 780 CMR, Seventh Edition). This Code sets forth insulation R-values well in excess of prior editions and evokes an engineering response opting for thicker insulation and correspondingly larger cavities.

Numerous improvements to masonry wall reinforcement have been made by H&B. In 1976, Hala and Schwalberg of H&B, received U.S. Pat. No. 3,964,226 for an adjustable wall-tie reinforcing system which joined reinforcements in inner and outer wythes with an attached eye and pintle structure. During the period when the Uniform Building Code developed joint reinforcement specifications, Hohmann et al. received U.S. Pat. No. 5,454,200 issued Oct. 3, 1995 and U.S. Pat. No. 6,279,283 issued Aug. 28, 2001. Examples of additional H&B inventions which resolve complex issues relating to cavity wall construction include U.S. Pat. Nos. 6,279,283; 6,668,505; 6,789,365; 6,851,239; and 7,325,366. These patents provide veneer anchoring systems for masonry walls which include reinforcement for cavity walls and describe anchors that have received widespread usage in the industry. However, none of these devices offers a hybrid backup wall reinforcement and anchor that when combined with the disclosed wire formative veneer tie provides reinforcement and 3-axis displacement protection.

Basic ladder and truss reinforcements are well known in the art. Exemplary of such basic reinforcements are in a patent to Stephen Priest, Jr., U.S. Pat. No. 903,000 issued Nov. 3, 1908, entitled "Wall Tie," which provides a reinforcing ladder device constructed of twisted wires with one side of the ladder device embedded in the outer wythe and the other, in the inner wythe. Similarly, H. Spaight, U.S. Pat. No. 2,300,181 issued Oct. 27, 1942, entitled "Means for Constructing Buildings," teaches a truss shaped reinforcement device for embedment in either one wythe or in cavity walls in both withes. More recently, W. Smith in U.S. Pat. No. 3,183,628 issued May 18, 1965, entitled "Masonry Wall Reinforcing Means," describes an improvement of the Spaight invention by teaching truss and ladder reinforcements having grooves or bosses on the parallel side wires to increase the mortar bonding therewith. The placement of one of the aforementioned devices in the horizontal mortar joints enhances the tensile strength of the horizontal joints.

The present invention employs a novel hybrid device that combines an inner wythe or backup wall with a wall anchor that provides a 3-axis restraint system, which measurably improves the stability of the overall cavity wall structure. The backup wall reinforcement anchoring system includes an integrated anchor that ensures an unbroken connection between these two essential components and, by integrating the two elements reduces the number of components at the job site. The integrated anchor is constructed in a manner to tightly receive a veneer tie and limit movement of the tie within the anchor. The connection of the anchor and veneer tie is accomplished without tools by manually inserting a veneer tie through the anchor.

Limiting veneer tie movement protects against movement and shifting of the exterior wall, which is a cause of structural damage. Further seismic protection is provided through the attachment of a reinforcement wire to the veneer tie and set within the exterior wall. The hybrid reinforcement and anchor assembly reduces the number of bits and pieces brought to the job site while manual insertion interengagement simplifies installation.

In preparing for this application the below-mentioned patents have become known to the inventors hereof. The following patents, not previously discussed, are believed to be relevant:

| Patent | Inventor | Issue Date |
|---|---|---|
| 3,377,764 | Storch | Apr. 16, 1968 |
| 4,227,359 | Schlenker | Oct. 14, 1980 |
| 4,819,401 | Whitney, Jr. | Apr. 11, 1989 |
| 4,869,038 | Catani | Sep. 26, 1989 |
| 5,392,581 | Hatzinikolas et al. | Feb. 28, 1995 |
| 5,490,366 | Burns et al. | Feb. 13, 1996 |
| 6,351,922 | Burns et al. | Mar. 5, 2002 |
| 6,735,915 | Johnson, III | May 18, 2004 |
| 7,152,382 | Johnson, III | Dec. 26, 2006 |

U.S. Pat. No. 3,377,764—D. Storch—Issued Apr. 16, 1968

Discloses a bent wire, tie-type anchor for embedment in a facing exterior wythe engaging with a loop attached to a straight wire run in a backup interior wythe.

U.S. Pat. No. 4,227,359—Schlenker—Issued Oct. 14, 1980

Discloses a preassembled masonry reinforcement for cavity walls with corrugated metal wall ties pivotally and slidably connected with the reinforcement.

U.S. Pat. No. 4,819,401—Whitney, Jr.—Issued Apr. 11, 1989

Discloses a wire anchor for metal stud/brick veneer wall construction. The wire anchor has a U-shaped portion which spans the cavity, a transverse offset portion that engages the stud and a pair of attachment portions that snap into position on the stud.

U.S. Pat. No. 4,869,038—M. J. Catani—Issued Sep. 26, 1989

Discloses a veneer wall anchor system having in the interior wythe a truss-type anchor, similar to Hala et al. '226, supra, but with horizontal sheetmetal extensions. The extensions are interlocked with bent wire pintle-type wall ties that are embedded within the exterior wythe.

U.S. Pat. No. 5,392,581—Hatzinikolas et al.—Issued Feb. 28, 1995

Discloses a cavity-wall anchor having a conventional tie wire for embedment in the brick veneer and an L-shaped sheetmetal bracket for mounting vertically between side-by-side blocks and horizontally atop a course of blocks. The bracket has an opening which is vertically disposed and protrudes into the cavity. The opening provides for a vertically adjustable anchor.

U.S. Pat. Nos. 5,490,366 and 6,351,922—Burns et al.—Issued Feb. 13, 1996 and Mar. 5, 2002, respectively Discloses an adjustable wall tie for cavity walls with a tension anchor connected with an adjustable double-end hook or a J-shaped single-ended hook.

U.S. Pat. Nos. 6,735,915 and 7,152,381—Johnson, III—Issued May 18, 2004 and Dec. 26, 2006, respectively Discloses a masonry anchoring system for connecting two spaced apart masonry walls. The anchor includes a ladder or truss type support for positioning on top of a mortar joint and a bracket that lies in the space between the two walls. The bracket is designed to receive a connecting member to connect the two walls.

Accordingly, while several distinct devices were developed to provide a connection between the backup and exterior walls, the current state of the art does not fulfill the need for an economical hybrid anchor and reinforcement assembly that provides a 3-axis restraint system utilizing a wire formative veneer tie. As described hereinbelow, the present invention provides a manually assembled, integrated backup wall and anchor assembly with a veneer tie connector that upon installation limits movement in x-, y- and z-axes, thereby simplifying installation and providing a useful and novel solution to the aforementioned difficulties.

SUMMARY

The present invention is a hybrid anchoring system for cavity walls. The reinforcement is a wire formative with side and intermediate wires disposed in the backup wall. The reinforcement is constructed in a ladder or truss configuration and contains an anchor integral therewith formed from a side wire and an intermediate wire configured to extend into the wall cavity. The integrated anchor is a wire formative that extends from the side wire to form a buckle. The buckle has a single or two-receptor opening.

The veneer tie or veneer anchor is a wire formative designed to connect with and be secured within the buckle and the exterior wall bed joint. The veneer tie has an interengaging portion for connection within the buckle and an insertion or free end for embedment in the bed joint of the veneer. The interengaging end of the veneer tie is constructed to curve around and surround the buckle so as to interengage therewith. Upon installation, the veneer tie spans the cavity and is inserted within the bed joint of the exterior wall in a manner that positively interlocks the tie and the anchor or buckle. The veneer tie is constructed to allow the veneer tie inserted into the buckle without the use of tools. For greater seismic protection, the veneer tie is configured to accommodate placement of a reinforcement wire within the veneer tie and the bed joint of the exterior wall.

An alternative anchoring system is designed with a buckle formed from the side wire, intermediate wire and a cross bar. The buckle has a single opening and the associated veneer tie is a wire formative designed for insertion and interlocking with the buckle. Similarly, another alternative anchoring system is constructed with a two-receptor buckle formed from crimping the side wire into eyelets for connection with a pintle-type wire formative veneer tie. The veneer ties are designed for manual insertion within the anchor and the veneer.

It is an object of the present invention to provide a manually assembled, hybrid reinforcement and anchoring system for masonry backup walls.

It is another object of the present invention to provide an anchoring system that upon installation provides a 3-axis restraint system to limit veneer displacement.

It is a further object of the present invention to provide an anchoring system comprising a limited number of component parts that are economical of manufacture resulting in a low unit cost.

It is yet another object of the present invention to provide an anchoring system with a wire formative veneer tie that is easy to install and meets seismic and shear resistance requirements.

It is another object of the present invention to provide labor-saving devices to simplify the anchoring of brick and stone veneer and the securement thereof to a backup wall.

It is a feature of the present invention that the anchor, the integrated wall anchor and wall reinforcement are dimensioned so that, when inserted into the respective mortar layers, the mortar thereof can flow around the wall-anchor-to-reinforcement-wire joint.

It is a further feature of the present invention that the anchor is formed integrally with the backup wall reinforcement to accept a veneer tie.

It is another feature of the present invention that the anchor is constructed to, upon installation, positively interlock with the veneer tie to provide a 3-axis restraint system.

Other objects and features of the invention will become apparent upon review of the drawings and the detailed description which follows.

BRIEF DESCRIPTION OF THE DRAWINGS

In the following drawings, the same parts in the various views are afforded the same reference designators.

DETAILED DESCRIPTION

Figure 1:
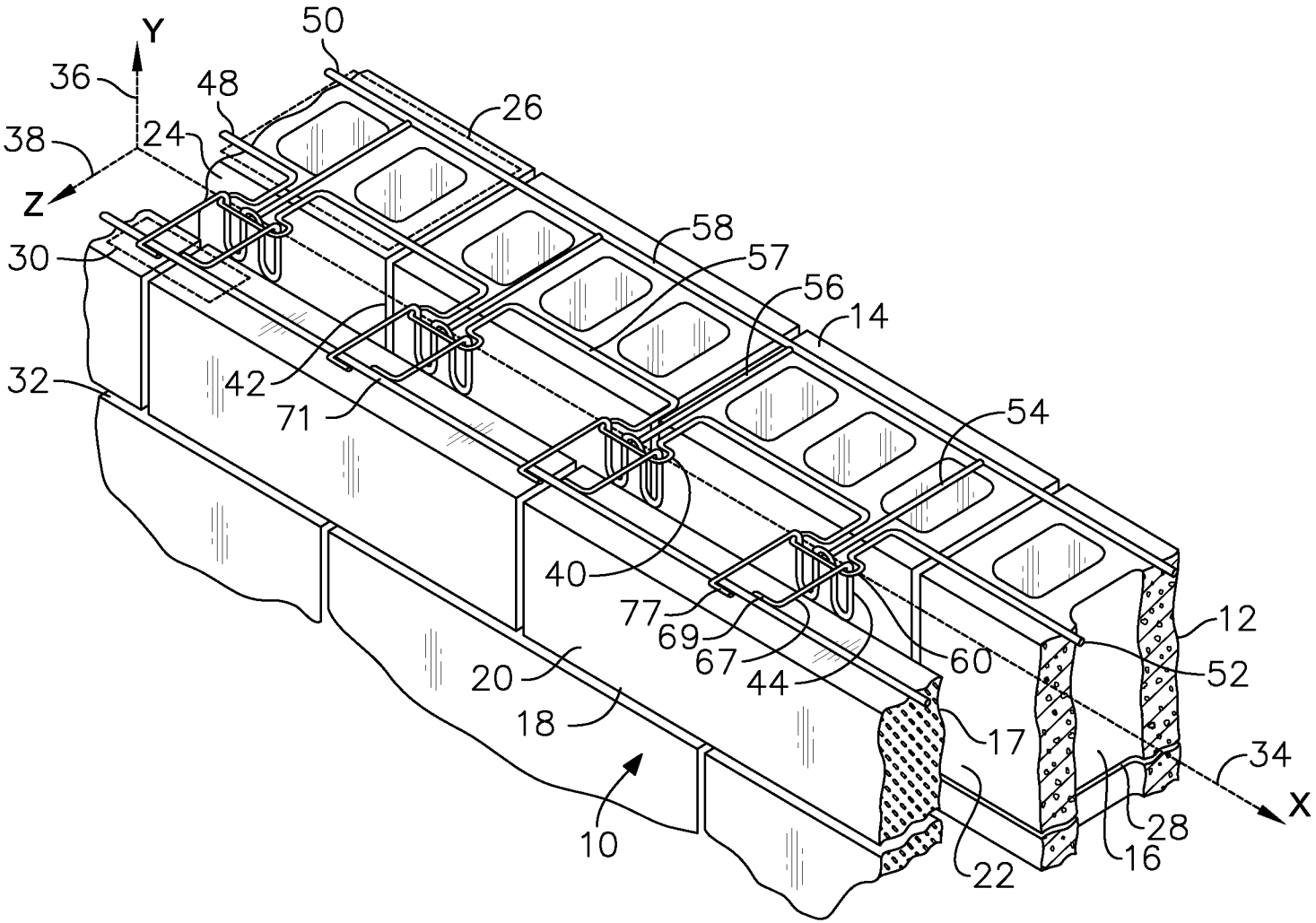
FIG. 1 is a perspective view of a first embodiment of a backup wall reinforcement with a T-type siderail anchoring system of this invention, including a ladder reinforcement with integral anchor formed from the siderail and intermediate wire connected to a veneer tie and reinforcement wire and shows a cavity wall with a backup wall of masonry block, and a facing wall of brick veneer.

Before entering into the Detailed Description, several terms are defined, which terms will be revisited later, when some relevant analytical issues are discussed. As previously discussed, stronger joint reinforcements are required in the inner wythe or backup wall to support the stresses imparted by anchoring the exterior wall or veneer to the inner wythe. As described hereinbelow, this is accomplished while still maintaining building code requirements for masonry structures, including the mortar bed joint height specification—most commonly 0.375 inches. Although thicker gauge wire formatives are used when required for greater strength, it is still desirable to have the bed joint mortar cover the wall anchor structure. Thus, the wall reinforcements are usually structured from 0.148 or 0.187 inch wire, and, in practical terms, the wire formatives hereof that are inserted into the bed joints of the inner wythe have a height limited to approximately 0.187 inch. Further, for the purposes of this Application the term longitudinal axis as it relates to the side and intermediate wires of the reinforcement (as further described and defined below) is defined by the side wire portion of the reinforcement without including the T-type portions extending into the cavity.

In the detailed description that follows, the wall reinforcements, the wall anchors, and the veneer ties are wire formatives. The wire used in the fabrication of masonry joint reinforcement conforms to the requirements of ASTM Standard Specification A9521-00, Table 1. For the purpose of this application weld shear strength test, tensile strength tests and yield tests of masonry joint reinforcements are, where applicable, those denominated in ASTM A-951-00 Standard Specification for Masonry Joint Reinforcement. In the descriptions of wall anchors which follow, the wall anchors are extension of the ladder-type or the truss-type reinforcements. As the attachment methodology follows that of fabricating the Masonry Joint Reinforcements, the tests for the wall anchors, except where fixturing is dictated by configuration, follow the A-951 procedures.

In the detailed description of the anchoring systems hereof the various wall anchor embodiments have elements which receive interlocking or interengaging portions of the veneer ties. The wall reinforcements and anchors are wire-formatives of varied shapes and configurations horizontally disposed in the cavity for receiving and interlocking with veneer ties. The veneer ties are wire formatives.

Another term defined for purposes of this application is wall reinforcement. A wall reinforcement is a continuous length of Lox All™ Truss Mesh or Lox All™ Ladder Mesh manufactured by H&B or equivalent modified to include an integral anchor and adapted for embedment into the horizontal mortar joints of a masonry backup wall. The wall reinforcements are prefabricated from cold-drawn steel wire and have parallel side rods with fused cross rods or truss components. The wall reinforcements for anchoring systems are generally structured from wire that is at least 0.148 and 0.187 in diameter. Further, the term masonry block is used to describe the materials of the backup wall and the exterior wall. Masonry block is defined to include brick, block, concrete masonry unit, stone, or any other similar material.

In the embodiments described herein below, the anchoring system for cavity walls is detailed. In masonry construction, shown in the embodiments hereof, utilizing this novel invention provides greater reinforcement and veneer displacement protection.

Referring now to FIG. 1 through 4 the first embodiment of an anchoring system utilizing a backup wall reinforcement with T-type siderails is shown and is referred to generally by the numeral 10. In this embodiment, a masonry wall structure 12 is shown having a backup wall or exterior wythe 14 of masonry blocks 16 and a facing wall, exterior wall or veneer 18 of facing brick or stone 20. Between the backup wall 14 and the facing wall 18, a cavity 22 is formed, which cavity 22 extends outwardly from the interior surface 24 of backup wall 14. The backup wall 14 and the facing wall 18 have interior surfaces or sides 24 and 17, respectively that face the cavity 22.

In this embodiment, successive bed joints 26 and 28 are formed between courses of blocks 16 and the joints are substantially planar and horizontally disposed. Also, successive bed joints 30 and 32 are formed between courses of facing brick 20 and the bed joints are substantially planar and horizontally disposed. For each structure, the bed joints 26, 28, 30 and 32 are specified as to the height or thickness of the mortar layer and such thickness specification is rigorously adhered to so as to provide the requisite uniformity for quality construction. Selected bed joint 26 and bed joint 30 are constructed to align, the one with the other so as to be substantially coplanar. For descriptive purposes, an x-axis 34 is drawn parallel to the intersection of the plane just described and the backup wall facial plane. Additionally, as seen in the drawing, an intersecting vertical line is drawn through the x-axis 34 to form the y-axis 36. A horizontal line or z-axis 38, normal to the xy-plane, also passes through the coordinate origin formed by the intersecting x- and y-axes.

In the discussion which follows, it will be seen that the various anchor structures are constructed to restrict movement interfacially—wythe vs. wythe—along the z-axis 38 and along the x-axis 34 and y-axis 36. The wall structure 10 includes a reinforcement device or hybrid wall reinforcement wall anchor 48 with an integral anchor or wall anchor portion 60. The reinforcement device 48 is embedded in the bed joints 26 and 28 and includes two side rails or wires 50, 52 which are parallel to each other. One or more intermediate wires 54, 56 are attached to the interior sides or surfaces of 57, 58 of the side rails 50, 52 and maintain the parallelism of the side rails 50, 52. The intermediate wires 54, 56 form a ladder configuration or optionally, a truss configuration (not shown). The longitudinal axis 15 of the intermediate wire 54 and the side rails 50, 52 is shown on FIG. 2. The side rails 50, 52 and the intermediate wires 54, 56 are substantially coplanar, and, when installed all lie in a substantially horizontal plane.

The reinforcement device 48 is a hybrid device which contains an integral anchor or wall anchor portion 60 formed from the side wire 52. The anchor 60 is designed to extend into the cavity 22 for connection with a veneer tie or veneer anchor 44. The anchor 60 is a T-type wire formative with leg portions 70, 72 and an intersecting intermediate wire 54 that forms a divided buckle or buckle portion 74 constructed to engage a veneer tie 44. The anchor 60 interengages with the veneer tie 44 and, upon installation in bed joint 30, the veneer tie is positively interlocked with the wall anchor 60.

Figure 4:
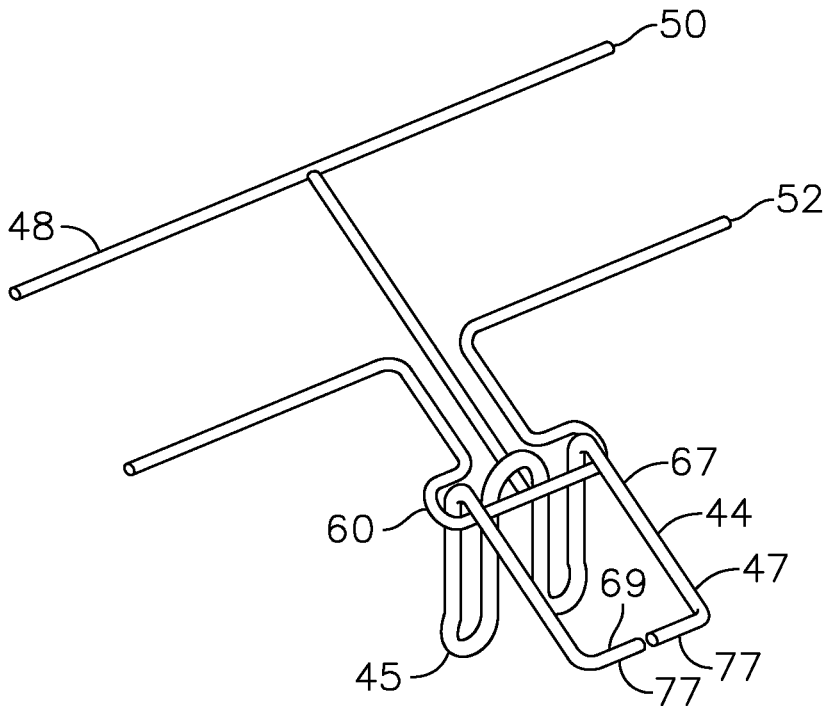
FIG. 4 is a perspective view of the ladder reinforcement with integral anchor and veneer tie of FIG. 1.

To anchor the veneer or outer wythe 18, a veneer tie or anchor 44 is constructed to interengage with the wall anchor 60. The veneer tie 44 is a wire formative which comprises an interengaging portion 45 continuous with cavity-spanning leg portions 67 and an insertion portion 77. As shown in FIG. 4, the interengaging portion 45 is constructed to surround and be secured within the divided buckle 74. When the interengaging portion 45 is disposed within the double buckle 74, x-axis 34 and z-axis 38 veneer 18 displacement is restricted by the dimensional relationships between the gage of the wire formative and the receptor opening of the anchor portion 60. Upon insertion of the veneer tie 44 in the veneer 18, y-axis 36 veneer 18 displacement is restricted by the curvature of the interengaging portion 45. The securement of the anchor 60 to the veneer tie 44 is accomplished without tools, lessening the burden on the installer and the number of parts and devices required to complete the anchoring system construct.

Figure 9:
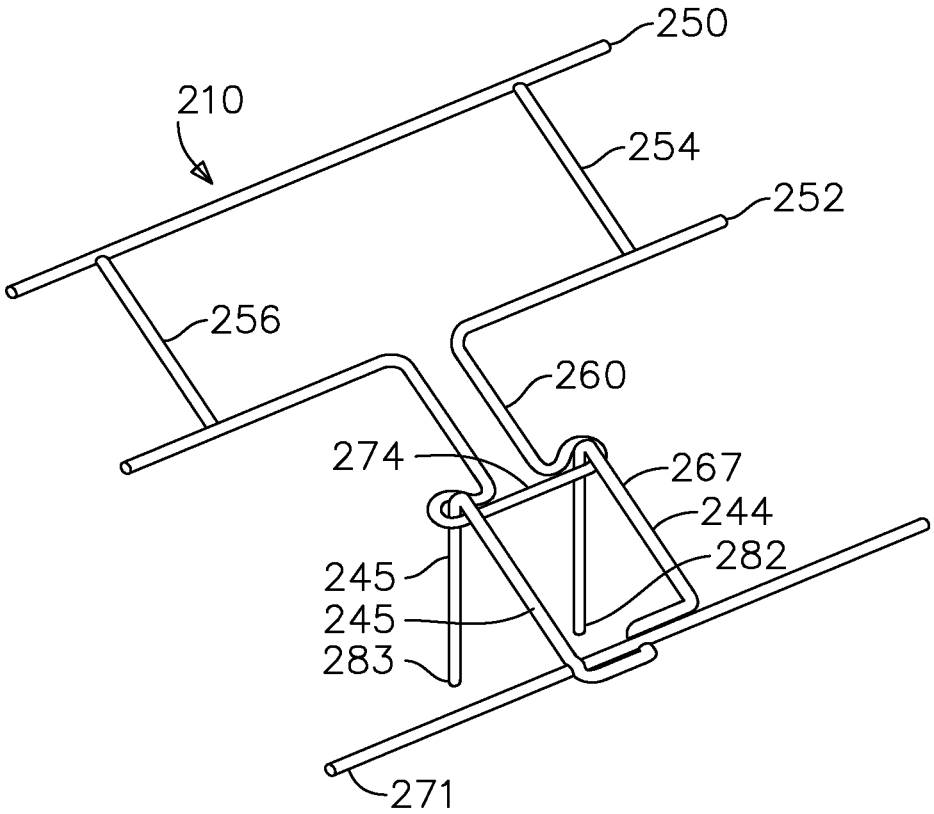

The insertion portion 47 of the veneer tie 44 free end portion 47 includes a cavity-spanning portion 67 and an insertion portion or bed joint portion 77. Upon installation, the cavity portion 67 extends across the cavity and the bed joint portion 77 is disposed within the bed joint 30 of the veneer 18. When inserted in the veneer 18, the insertion portion 47 is in a substantially horizontal plane with the bed joint 30. The bed joint portion 77 may optionally be offset and have a notch or swage 69 to accommodate a reinforcement wire 71 within the bed joint portion 77 for embedment in the bed joint 30 of the veneer 18. The inclusion of the reinforcement wire forms a construct meeting seismic standards. Optionally, insulation 25 may be added to the interior 24 of the backup wall 16 (see FIG. 1A). Alternatively, a pintle veneer tie as shown in FIG. 9 may be utilized with the divided buckle 74.

Figure 5:
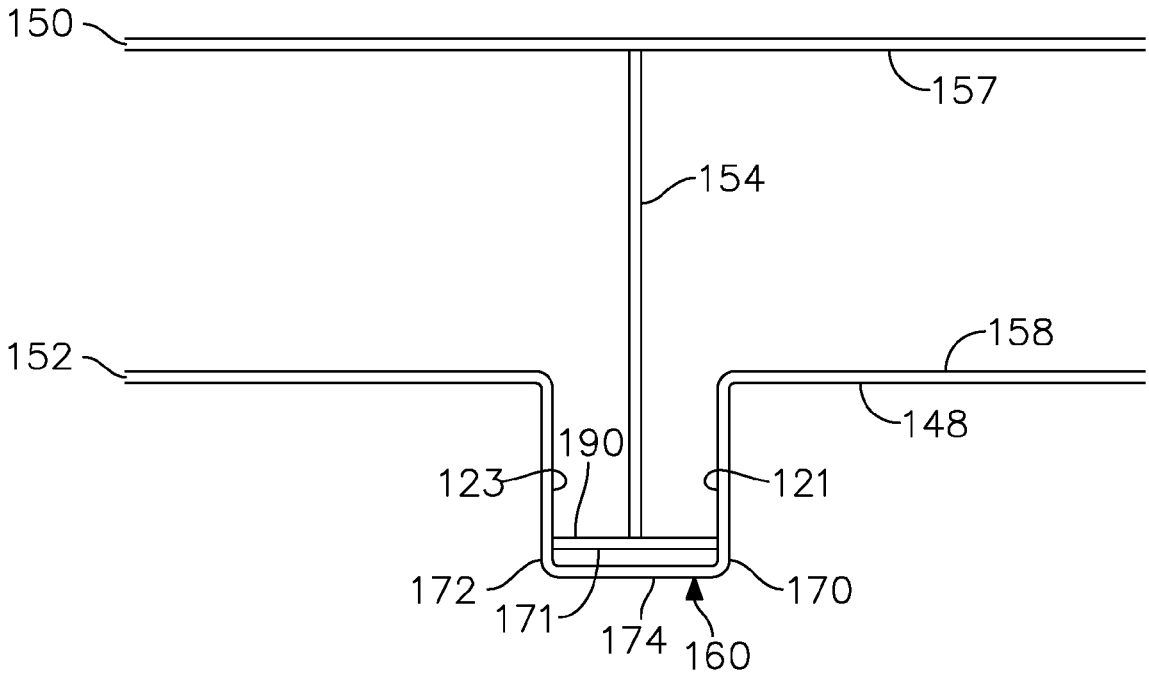
FIG. 5 is a top plan view of a second embodiment of the ladder reinforcement with the integral anchor of the backup wall reinforcement with T-type siderail system of this invention.
Figure 6:
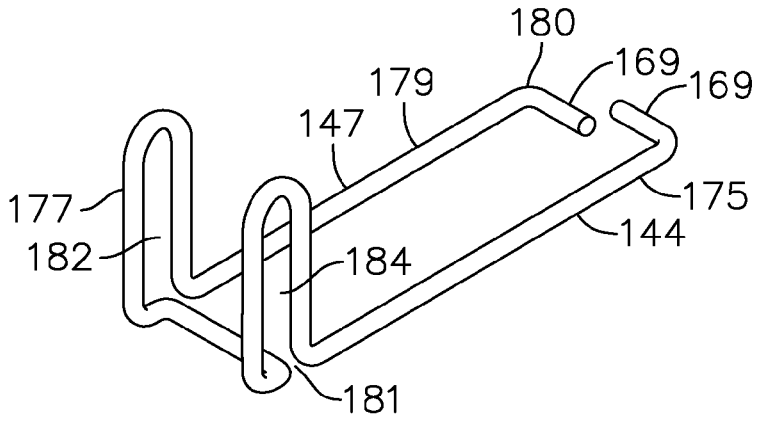
FIG. 6 is perspective view of the veneer tie for use with the ladder reinforcement with integral anchor of FIG. 5.
Figure 7:
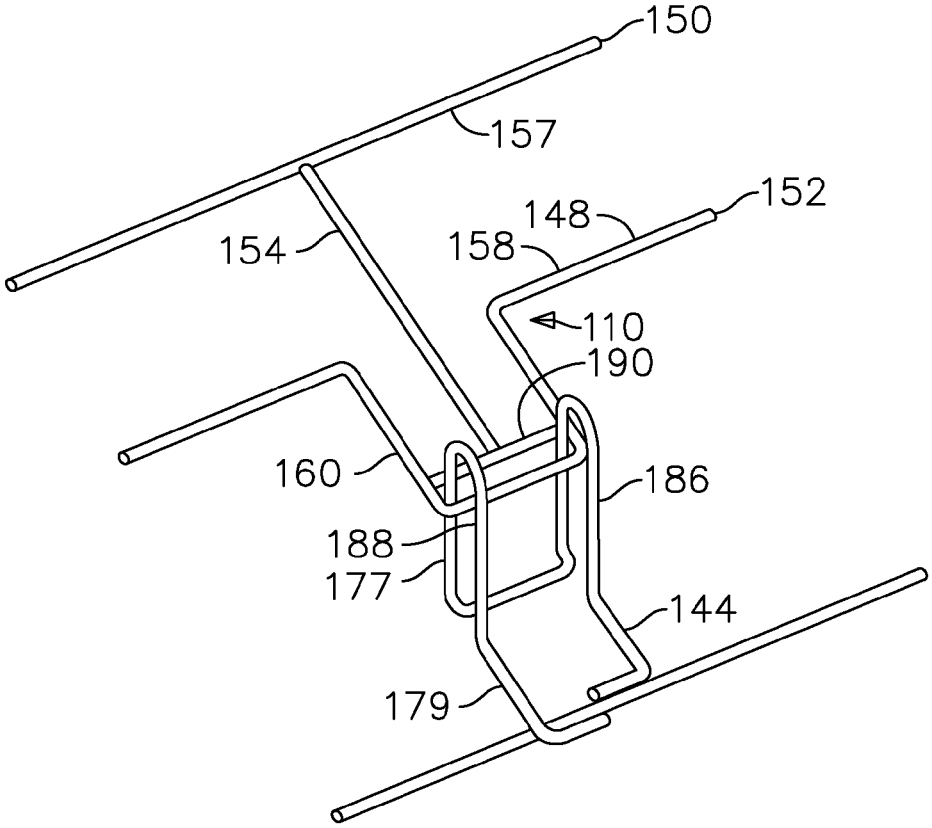
FIG. 7 is a perspective view of the veneer tie of FIG. 6 interlocked with the ladder reinforcement with integral anchor of FIG. 5.

The description which follows is of a second embodiment of an anchoring system utilizing a backup wall reinforcement with siderails incorporating T-type anchors. For ease of comprehension, where similar parts are used, reference designators "100" units higher are employed. Thus, the anchoring system 110 of the second embodiment is analogous to the anchoring system 10 of the first embodiment. Referring now to FIGS. 5 through 7, the second embodiment of a backup wall reinforcement with T-type siderails of this invention is shown and is referred to generally by the numeral 110.

Figure 1A:
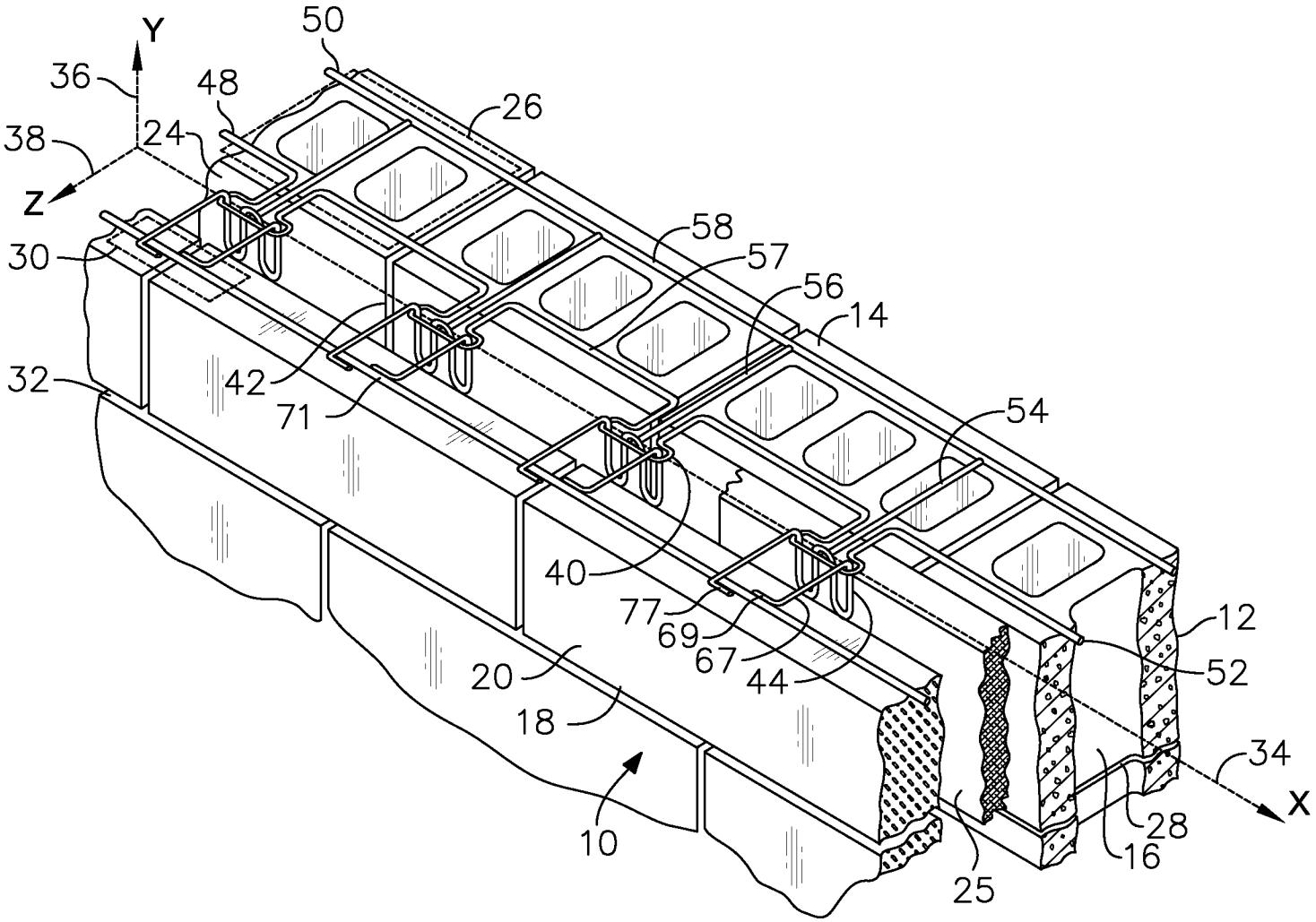
FIG. 1A is a perspective view of the first embodiment illustrated in FIG. 1 and illustrates the optional use of insulation against the backup wall of masonry block.
Figure 2:
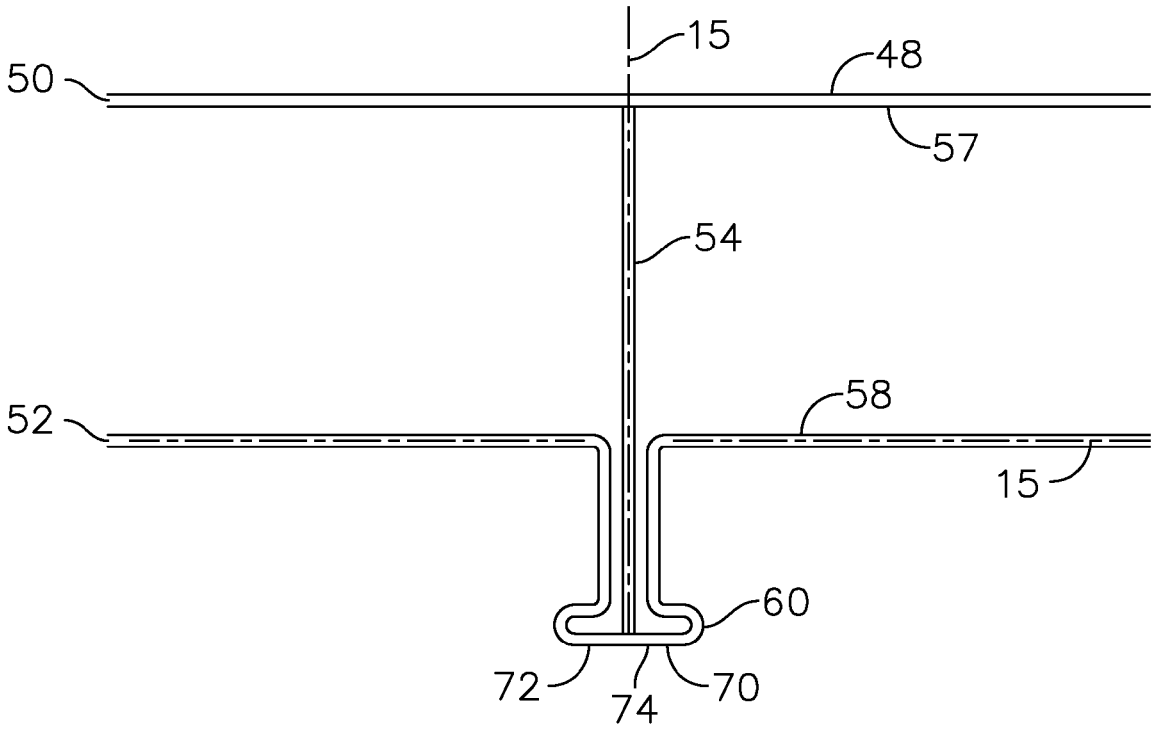
FIG. 2 is a top plan view of the ladder reinforcement with integral anchor of FIG. 1.
Figure 3:
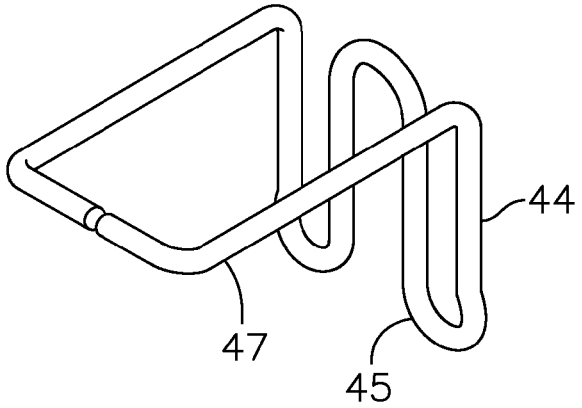
FIG. 3 is a perspective view of the veneer tie of FIG. 1.

In this embodiment, a cavity wall structure is not shown but is substantially similar to the cavity wall structure shown in FIG. 1. The anchoring system 110 includes a reinforcement device or hybrid wall reinforcement wall anchor 148 with an integral anchor or wall anchor portion 160. The reinforcement device 148 is embedded in the bed joints of the backup wall and includes two side rails or wires 150, 152 which, exclusive of the anchor, are parallel to each other. One or more intermediate wires 154 are attached to the interior sides or surfaces of 157, 158 of the side rails 150, 152 and maintain the parallelism of the side rails 150, 152. The intermediate wires 154 form a ladder configuration or optionally, a truss configuration (not shown). The longitudinal axes of the intermediate wires 154 and of the side rails 150, 152 are substantially similar to those shown on FIG. 2. The longitudinal axes of the side rails 150, 152 and of the intermediate wires 154 are substantially coplanar, and, when the reinforcement device 148 is installed all the longitudinal axes are substantially horizontal.

The reinforcement device 148 is a hybrid device which contains an integral anchor or wall anchor portion 160 formed from the side wire 152. The anchor 160 is designed to extend into the wall cavity and to form any shape that would adequately connect with the veneer tie or veneer anchor 144. For ease of fabrication, continuous wire formatives are selected obviating the need for excessive welding or fusing of wire segments. Specifically, the wall anchor 160 extends in a simple U-shape into the cavity 122. The anchor 160 contains wire formatives or leg portions 170, 171, 172. The leg portions 170 and 172 have an interior surface 121, 123, respectively. A cross bar 190 connects the interior surfaces 121, 123 of the leg portions 170, 172. The cross bar 190 is substantially parallel to the side wires 150, 152 and when connected to the wire formatives 170, 172 forms a buckle or buckle portion 174 for connection with a veneer tie 144. For added structural support, an intermediate wire or intersecting wire 154 is connected to the cross bar 190. The length of intermediate wire 154 is selected so that the opening between crossbar 190 and leg portion 171 is slightly greater than the gage of the veneer tie thereby limiting z-axis movement of the veneer.

To anchor the veneer or outer wythe 118, a veneer tie or anchor 144 is constructed to interengage with the wall anchor 160. The veneer tie 144 is a wire formative. The veneer tie 144 provides an interlocking portion 177 continuous with the cavity-spanning portion 179 and with the insertion portion 180. The interlocking portion 177 has a throat opening 181 that is slightly greater than the gage of leg portion 171 enabling interlocking portion 177 to be threadedly mounted onto and be secured within the buckle 174. The securement of the anchor 160 to the veneer tie 144 is accomplished without tools, lessening the burden on the installer and the number of parts and devices required to provide a complete veneer anchoring construct.

The interlocking portion 177 is constructed with a pair of elongated openings 182 and 184 and curved in a manner (as shown in FIG. 6) to provide vertical adjustability and, in turn, limit the y-axis movement of the veneer. The leg portions 186 and 188 surrounding openings 182 and 184, respectively, are spaced apart so that, upon insertion in the buckle 174 the x-axis movement of the veneer is restricted. Thus, once connected to the anchor 160 and secured within the veneer 118, the veneer tie 144 movement is restricted along the x- and z-axes by dimensional selection and along the y-axis by the specified elongation and curvature of the interlocking potion 177 which limits y-axis movement once the insertion portion is fixed in the horizontal bed joint.

The veneer tie 144 contains a cavity-spanning portion 179 that spans the cavity 122 and an insertion portion or bed joint portion 180 that is inserted into the bed joint of the facing wall. Upon embedment of the veneer tie 144 into the bed joint of the facing wall, the cavity-spanning portion 179 and the insertion portion 180, lie in a substantially horizontal plane. With the anchors 160 positioned as described, the veneer tie 144 is positively interlocked and cannot be twisted freely. The insertion portion 180 contains an offset 169 to secure a reinforcement wire 171 for embedment in the bed joint of the facing wall. The capability of including a reinforcement wire in the veneer enables the structure to meet seismic specifications.

When insulation is installed onto the interior of the backup wall, the interlocking portion 177 abuts the insulation and provides additional support therefor. The securement of the anchor 160 to the veneer tie 144 is accomplished without tools, lessening the burden on the installer and the number of parts and devices required to complete the anchoring system.

The description which follows is of a third embodiment of an anchoring system utilizing a hybrid backup wall reinforcement having integral T-type anchors. For ease of comprehension, where similar parts are used reference designators "200" units higher are employed. Thus, the wall reinforcement portion 48 of the first embodiment and the wall reinforcement portion 148 of the second embodiment are analogous to the wall reinforcement portion 248 of the third embodiment.

Figure 8:
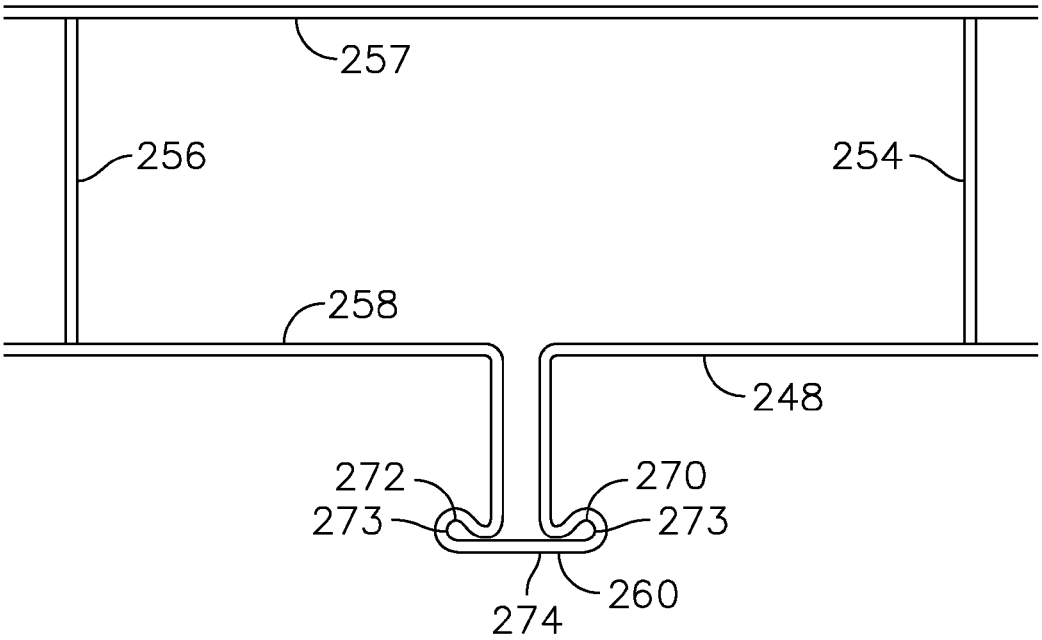
FIG. 8 is a top plan view of a third embodiment of the ladder reinforcement with integral anchor of the backup wall reinforcement with T-type siderail system of this invention; and, FIG. 9 is a perspective view of the ladder reinforcement with integral anchor of FIG. 8 with a veneer tie inserted within the anchor, a reinforcement wire is inserted within the veneer tie.

Referring now to FIGS. 8 and 9, the third embodiment of a hybrid backup wall reinforcement having T-type anchors of this invention is shown and is referred to generally by the numeral 210. In this embodiment, a cavity wall structure is not shown, but is substantially similar to the cavity wall structure shown in FIG. 1. The anchoring system 210 includes a reinforcement device or wall reinforcement portion 248 with an integral anchor or wall anchor portion 260. The reinforcement device 248 is embedded in the bed joints and includes two side rails or wires 250, 252 which are parallel to each other. One or more intermediate wires 254, 256 are attached to the interior sides or surfaces of 257, 258 of the side rails 250, 252 and maintain the parallelism of the side rails 250, 252. The intermediate wires 254, 256 form a ladder configuration or optionally, a truss configuration (not shown). The longitudinal axis of the intermediate wires 254, 256 and the side rails 250, 252 is substantially similar to that shown on FIG. 2. The side rails 250, 252 and of the intermediate wires 254, 256 are substantially coplanar, and, when installed all lie in a substantially horizontal plane.

The reinforcement device 248 is a hybrid device which contains an integral anchor or wall anchor portion 260 formed from the side wire 252. The anchor 260 is designed to extend into the wall cavity for connection with a veneer tie or veneer anchor 244. The anchor 260 contains T-type wire formatives or leg portions 270, 272 that form a two-receptor buckle 274 designed to engage a veneer tie 244. The two-receptor buckle is formed by configuring the T-type wire formatives 270, 272 into eyelets 273. To ensure a tight-fitting connection, the eyelets 273 are slightly larger than the gauge of the veneer tie 244 wire formative thereby restricting x- and y-axis movement. Optionally, for added strength, the crimped T-type wire formatives 270, 272 are welded.

To anchor the veneer or outer wythe, a veneer tie or anchor 244 is constructed to interengage with the wall anchor 260. The veneer tie 244 is a wire formative which comprises dual pintle portion 245 and an insertion portion 247. The dual pintle portion 245 has two curved pintles 282, 283 that extend through the eyelets 273 and are secured within the two-receptor buckle 274. When the insertion portion 247 is embedded within the corresponding bed joint of the veneer wall, the insertion portion 247 is held in a substantially horizontal position and the curvature of the pintles 282, 283 limits the y-axis movement when the insertion portion 247 is fixed in the horizontal bed joint. The securement of the anchor 260 to the veneer tie 244 is accomplished without tools, lessening the burden on the installer and the number of parts and devices required to complete the seismic construct.

The veneer tie 244 insertion portion 247 includes a cavity portion 267 and an insertion portion or bed joint portion 277. The cavity portion 267 spans the cavity and the bed joint portion 277 is dimensioned for disposition within the bed joint of the facing wall. When inserted in the facing wall, the insertion portion 247 lies in a substantially horizontal plane with the bed joint. The bed joint portion 277 is optionally swaged to accommodate a reinforcement wire within the bed joint portion 277 for embedment in the bed joint of the facing wall. The inclusion of the reinforcement wire enables the anchoring construct to meet seismic specification. Additionally, optional insulation may be added to the interior of the backup wall.

The anchoring system of this invention provides greater seismic and sheer protection than the prior art through the use of a hybrid reinforcement and anchor device with an interlocking veneer tie. The present device achieves this advancement through the use of a 3-axis restraint system between the anchor, veneer tie and outer wythe limiting veneer displacement along the x- y- and z-axes.

The anchoring system utilizes only the cavity wall structure and three components, the reinforcement/anchor, veneer tie and reinforcement wire to obtain the 3-axis restraint system and reinforcement and seismic protection. The limited number of manually installed components provides an easy to install economical solution providing a significant improvement over the prior art.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. An anchoring system for use in a cavity wall having a backup wall and a facing wall in a spaced apart relationship having a cavity therebetween, said backup wall and said facing wall each having an interior side facing said cavity, said backup wall and said facing wall each formed from successive courses of masonry block each with a bed joint of predetermined height between each two adjacent courses and, further, each course of masonry block having an embedment surface lying in a substantially horizontal plane, said anchoring system comprising:

a hybrid wall reinforcement wall anchor adapted for disposition upon one of said courses of masonry blocks for embedment in said bed joint of said backup wall, said hybrid wall reinforcement wall anchor, further, comprising;

a pair of side wires with the longitudinal axes thereof disposed parallel the one to the other, said pair of side wires having interior surfaces disposed opposite each other;

one or more intermediate wires each having a longitudinal axis, said one or more intermediate wires attached to said interior surfaces of said side wires maintaining the parallelism thereof and having the axes of said side wires and said intermediate wires being substantially coplanar;

at least one wall anchor portion formed from one of said pair of side wires of said wall reinforcement, said wall anchor portion further comprising, first and second legs formed from said one of said pair of side wires, the first and second legs extending transverse to the longitudinal axes of the remainder of the side wires and at least partially defining a buckle portion extending into said cavity, said buckle portion being a wire formative dimensioned to engage a veneer tie, wherein at least one of said intermediate wires extends transverse to the longitudinal axes of the remainder of the side wires and between the first and second legs; and a cross bar connecting an interior surface of each of the first and second legs, the cross bar being substantially parallel to and spaced from the side wires, said one of said intermediate wires extending between the first and second legs connecting to the cross bar at a location between the legs; and a veneer tie wire formative, said veneer tie further comprising, an interengaging portion dimensioned to extend through said buckle portion; and a free end portion continuous with said interengaging portion.

2. An anchoring system as described in claim 1, wherein said interengaging portion is curved to surround and be secured within said buckle portion.

3. An anchoring system as described in claim 2, wherein said free end portion further comprises:

a cavity-spanning portion, said cavity-spanning portion configured to span said cavity; and an insertion portion, said insertion portion continuous with said cavity-spanning portion and dimensioned for disposition within said bed joint of said facing wall.

4. An anchoring system as described in claim 3, wherein said insertion portion is dimensioned to receive a reinforcement wire.

5. An anchoring system as described in claim 4, wherein said anchoring system further comprises:

a reinforcement wire, said reinforcement wire for insertion within said insertion portion, whereby, upon installation a seismic construct is formed.

6. An anchoring system as described in claim 1, wherein said backup wall further comprises a layer of insulation whereby upon installation of said veneer tie, said interengaging portion is dimensioned to be secured against said insulation.

7. An anchoring system for use in a cavity wall having a backup wall and a facing wall in a spaced apart relationship having a cavity therebetween, said backup wall and said facing wall each having an interior side facing said cavity, said backup wall and said facing wall each formed from successive courses of masonry block each with a bed joint of predetermined height between each two adjacent courses and, further, each course of masonry block having an embedment surface lying in a substantially horizontal plane, said anchoring system comprising:

a hybrid wall reinforcement wall anchor portion adapted for disposition upon one of said courses of masonry blocks for embedment in said bed joint of said backup wall, said hybrid wall reinforcement wall anchor, further comprising:

a pair of side wires with the longitudinal axes thereof disposed parallel the one to the other, said pair of side wires having interior surfaces disposed opposite each other;

one or more intermediate wires each having a longitudinal axis, said one or more intermediate wires attached to said interior surfaces of said side wires maintaining the parallelism thereof and having the axes of said side wires and said intermediate wires being substantially coplanar;

at least one wall anchor portion formed from one of said pair of side wires of said wall reinforcement, said wall anchor portion further comprising:

first and second legs formed from said one of said pair of side wires, the first and second legs at least partially defining a buckle portion formed from one of said side wires extending into said cavity, said buckle portion having an interior surface, said buckle portion including a receiving space for receiving a veneer tie through said buckle portion;

a cross bar connecting an interior surface of each of said first and second legs, said cross bar substantially parallel to and spaced from said side wires, said receiving space being defined at least in part by said first and second legs and said cross bar; and an intersecting wire connecting said interior surface of said side wire to said cross bar, the intersecting wire extending between the first and second legs and connecting to the cross bar at a location between the legs; and a veneer tie, said veneer tie being a wire formative, said veneer tie further comprising, an interlocking portion dimensioned to extend through said buckle portion; and a bed joint portion continuous with said interlocking portion.

8. An anchoring system as described in claim 7, wherein said intersecting wire is an intermediate wire.

9. An anchoring system as described in claim 7, wherein said interlocking portion is curved to surround and be secured within said buckle portion.

10. An anchoring system as described in claim 9, wherein said bed joint portion further comprises:

a cavity-spanning portion configured to span said cavity;

an insertion portion continuous with said cavity-spanning portion and dimensioned to receive a reinforcement wire, said insertion portion configured for disposition within said bed joint of said facing wall.

11. An anchoring system as described in claim 10, wherein said interlocking portion and said cavity-spanning portion form a throat to allow insertion of said buckle portion between said interlocking portion and said cavity-spanning portion, whereby upon installation displacement of said veneer tie is restricted.

12. An anchoring system as described in claim 11, wherein said anchoring system further comprises:

a reinforcement wire, said reinforcement wire for insertion within said insertion portion, whereby, upon installation a seismic construct is formed.

13. An anchoring system as described in claim 7, wherein said backup wall further comprises a layer of insulation whereby upon installation of said veneer tie, said interlocking portion is dimensioned to be secured against said insulation.

14. An anchoring system as described in claim 7, wherein the interlocking portion comprises a first leg and a second leg, each of the first and second legs extending from the bed joint portion, each of the first and second legs comprising a first portion extending upward from the bed joint portion and a second portion continuous with and extending downward from the first portion, the second portion being configured to extend through the buckle portion.

* * * * *